US005150559A

United States Patent [19]

Winfield

[11] Patent Number: 5,150,559

[45] Date of Patent: Sep. 29, 1992

[54] FLUID CONTAINER CAPPER APPARATUS

[75] Inventor: Edward O. Winfield, Kansasville, Wis.

[73] Assignee: Plant Services Corp., Kenosha, Wis.

[21] Appl. No.: 772,474

[22] Filed: Oct. 7, 1991

[51] Int. Cl.[5] ..... B65B 7/28; B65B 61/00; B65B 1/00

[52] U.S. Cl. ..... 53/306; 53/308; 53/319; 53/367; 53/133.2

[58] Field of Search ..... 53/485, 306, 308, 310, 53/367, 133.2, 319

[56] References Cited

U.S. PATENT DOCUMENTS

| | | | |
|---|---|---|---|
| 1,689,815 | 10/1928 | Bunker | 53/300 X |
| 1,748,961 | 3/1930 | Risser | 53/308 X |
| 1,912,677 | 6/1933 | Williams | 53/367 X |
| 1,931,943 | 10/1933 | Weaver et al. | 53/300 X |
| 3,054,240 | 9/1962 | Dimond | 53/367 X |
| 3,214,881 | 11/1965 | Hayes | 53/485 |
| 3,882,660 | 5/1975 | Sterling | 53/367 X |
| 4,098,059 | 7/1978 | Chattillion | 53/367 X |
| 4,993,537 | 2/1991 | Bianchini et al. | 53/367 X |

*Primary Examiner*—Horace M. Culver
*Attorney, Agent, or Firm*—Dick and Harris

[57] ABSTRACT

An apparatus for mounting caps onto fluid containers in a predetermined particular orientation relative to the fluid containers. Caps are drawn from a source of caps and placed singly, in succession, on a cap seat which is in a particular known orientation. Each cap is taken, while on the cap seat, to a delivery position. During transfer to the delivery position, each cap is aligned into a known particular orientation. A device for picking up the caps takes each cap from the cap seat to a container and mounts the cap onto a waiting fluid container, in the desired predetermined orientation with respect to the fluid container. The device includes an operatively associated clamp that supports the fluid container about a flange around the neck to prevent crushing of the fluid container during mounting of the caps.

16 Claims, 6 Drawing Sheets

FLUID CONTAINER CAPPER APPARATUS

BACKGROUND OF THE INVENTION

The present invention relates to an apparatus for mounting caps onto fluid containers. In particular, the present invention relates to a device for mounting a cap in a particular predetermined orientation relative to a fluid container.

Apparata which mount caps onto fluid containers, such as containers for liquids, in general are well known. However, in several industries, for example, the bottled water industry, it has become popular to provide bottled water in a container which will also act as a dispenser, in a household refrigerator. To provide the simplest type of container which will also work as a dispenser, rectangular containers are provided with caps which feature openable and closeable spouts. With such a container set on a side and the spout open, the fluid can leave the container simply propelled by the force of gravity. Accordingly, such containers must be rectangular in cross-section, or at least not round, so that they will not roll about when they are laid on their side.

In order to function properly as a dispenser, the cap and spout must be placed on the container in a particular orientation. Specifically, since the cap, with integral spout, will likely be configured to permit flow from the cap in only one radial direction from the cap, the cap must be placed on the container with the opening pointing downward, when the container is laid on one side. In addition, since the fluid containers are often not substantially square, but may be rectangular with, for example, a neck and opening at one end of the top of the container, and with a handle or other feature at the other end of the top of the container, the container must therefore be set on a particular side in order to function as a dispenser. For this reason also, it is necessary that the cap be properly aligned when it is mounted onto the container, or failing that, adjusted by hand after mounting.

It is, therefore, desirable to provide a means for mounting the cap onto the fluid container already in the desired orientation for the following additional reasons. Firstly, to align the cap either manually or with other apparatus, after mounting, would tend to slow the operation of the bottling line. In addition, to the extent that the product which is being placed in the containers is a food product or other product which must be delivered to the consumer in a sealed condition, typically the containers are sealed while or immediately after the caps mounted. Accordingly, to either attempt to align the caps after sealing, which might break the seal, or introduce an additional step in the capping process for alignment after mounting of the caps, would prove difficult, costly, and time consuming.

It is, accordingly, an object of the present invention to provide an apparatus for mounting caps onto fluid containers, in such a manner that the caps are mounted onto the fluid containers in a previously determined particular desired orientation relative to the fluid container.

A further object of the present invention is to provide an apparatus for aligning caps for fluid containers into a particular pre-determined orientation relative to the fluid containers, prior to the mounting of the caps onto the fluid containers.

An example of a capping apparatus is shown in Choi, U.S. patent application Ser. No. 07/590,161, filed Sep. 28, 1991. In that application, caps are withdrawn from a hopper, in random relative rotational orientation. Each of the caps has an asymmetrical lower surface. The caps are brought to a cap drop position and placed on cap seat members which have upper surfaces which correspond to the asymmetrical lower surfaces of the caps. As the caps are transported from the cap drop position to a delivery position, the cap seat members are rotated while the caps themselves are prevented from rotating, until the caps are aligned with and fitted into the cap seat members. The caps are thus brought to the delivery position with the caps in a known rotational orientation, and are then picked up and placed on the necks of the awaiting bottles.

However, not all caps are provided with irregular or asymmetrical lower surfaces which may be used to index or align the caps into a desired relative orientation. Accordingly, it is a further object of the invention to provide an apparatus for mounting caps onto containers, which does not rely on using the lower surfaces of the caps for alignment.

It is becoming common practice, though, to provide frangible seals on caps or spouts for use on food or medicinal containers, or containers for household products. Such seals, in some cases, provide an element which may serve as a locator for placing the caps into a desired orientation. A further object of the invention, therefore, is to provide an apparatus which may utilize such projecting elements for aligning the caps.

These and other objects of the present invention will become apparent in view of the present Specification, Claims and Drawings.

SUMMARY OF THE INVENTION

The present invention comprises an apparatus for mounting caps onto fluid containers in a particular predetermined orientation relative to the fluid containers. The caps each have a top portion, a bottom portion with a substantially radially symmetrical seating portion, and a substantially radially symmetrical central portion intermediate the top and bottom portions with a radially outwardly extending element at a predetermined circumferential position on the central portion. The fluid containers associated with the apparatus each have a neck portion and an opening arranged at an end of the neck portion. The apparatus for mounting caps onto fluid containers in particular comprises a source of caps for the fluid containers, means for transporting each of the caps in succession from the source to a cap drop position with the caps arriving at the cap drop position in random relative orientation between successive caps. Also provided are means for seating each of the caps after each of the caps has arrived at the cap drop position, means for transferring the seating means from the cap drop position to a delivery position, means for aligning the caps, one at a time, from the random relative orientation into a predetermined seated alignment in the seating means, prior to arrival of the seating means at the delivery position, so as to orient the seating means and the caps respectively, into a predetermined position for pick-up and securement of each of the caps onto the neck portion of a corresponding one of the fluid containers, means for moving the fluid containers from a source of the fluid containers, successively, to a capping position; and means for picking up the caps at the delivery position and putting the caps onto the neck portion of the corresponding one of the fluid containers at the capping position to substantially cover the opening of the corresponding fluid containers.

The seating means comprises a cap seat member, having a symmetrical upper seating surface configured thereon to correspond to the symmetrical seating portion of each of the caps. Each cap is deposited, in succession, on the cap seat member when the seating means is in the cap drop position. The aligning means comprises means for rotating the cap seat member as well as means for permitting limited rotation of each of the caps which cooperates with the radially outwardly extending element. The caps rotate until each attains a predesigned orientation relative to the means for permitting limited rotation, and are thereafter precluded from rotating further until after the seating means are transferred to a position a predetermined distance from the delivery position. The cap seat member is further configured to rotate with the caps, until the caps attain the predesigned orientation relative to the means for permitting limited rotation. The cap seat member thereafter continues to rotate, now relative to the cap, until the seating means passes the means for permitting limited rotation. Thereafter, the cap seat means and the cap resume rotation together until the seating means arrives at the delivery position, in a predetermined orientation relative to the containers, such orientation being different from but related to the predesigned orientation.

The means for permitting limited rotation of the caps comprises a guide member which is positioned proximate the path of the seating means so that the outwardly extending element, at the predesigned orientation, abuts the guide member, as the cap rotates with the seating means, the cap thereafter being precluded from rotating relative to the means for permitting limited rotation as the seating means is transferred to the delivery position, until the seating means passes the guide member.

The rotating means is composed of a pinion arranged for rotation with the cap seat member, and a rack arranged for movement transversely to the axis of rotation of the pinion, to engage the pinion and cause rotation of the cap seat member as the cap seat member is transferred to the delivery position. In a preferred embodiment of the invention, the pinion and the cap seat are mounted for rotation about a common axis of rotation.

DETAILED DESCRIPTION OF THE DRAWINGS

Figure 1:
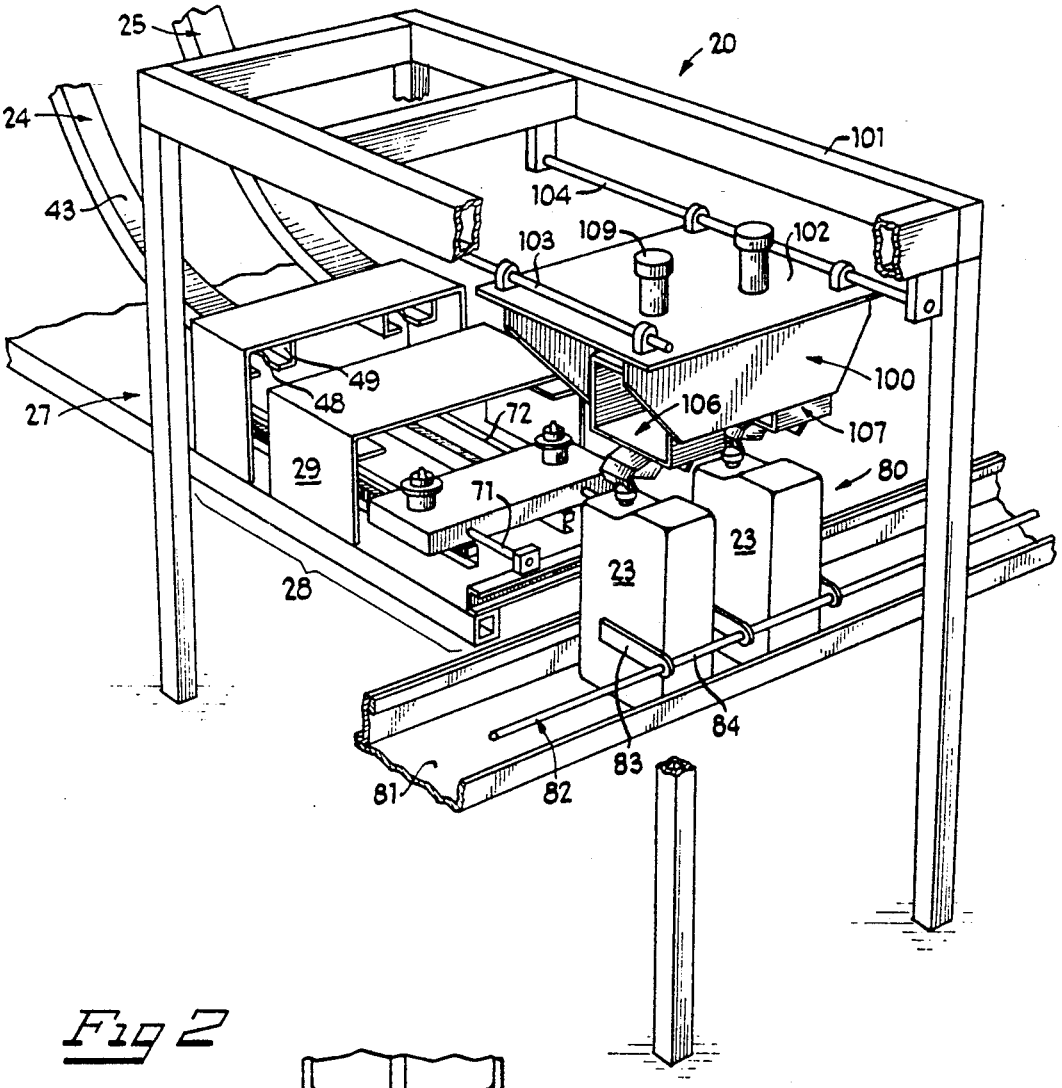
FIG. 1 is a left side perspective view of the fluid container capper apparatus according to a preferred embodiment of the invention.
Figure 2:
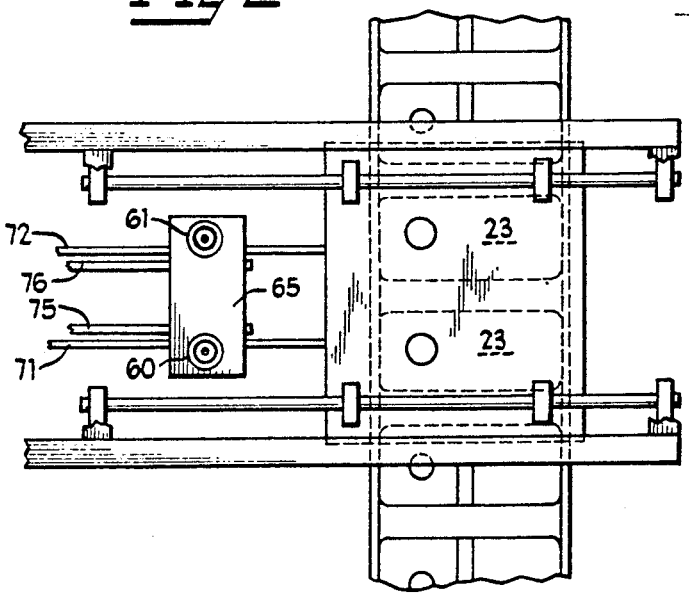
FIG. 2 is a top plan view of a portion of the capper apparatus according to FIG. 1.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Figure 6:
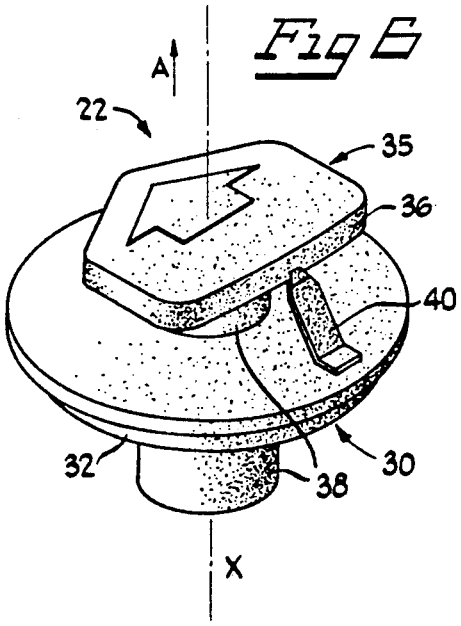
FIG. 6 is a top perspective view of a cap used in association with the preferred embodiments of the invention.
Figure 7:
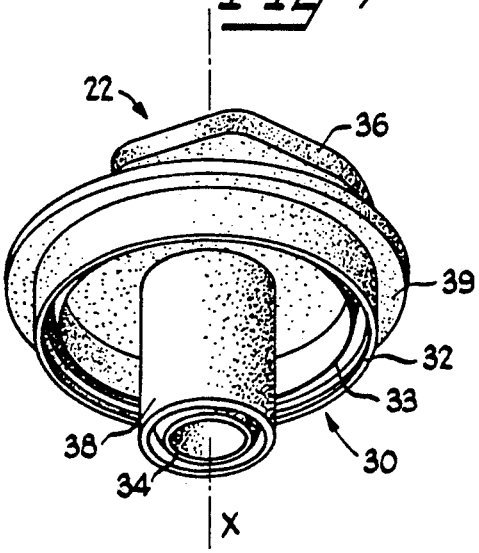
FIG. 7 is a bottom perspective view of the cap according to FIG. 6.

Fluid container capper apparatus 20, is seen in FIGS. 1–14. Capper apparatus 20 includes a source 21 of caps (See FIG. 3) which may be a conventional spiral unloading hopper or similar device Capper apparatus 20, is configured for capping two containers 23 at a time; the invention, however, may be applied for capping from one container at a time to any number simultaneously. Caps, such as cap 22, shown in FIGS. 6 and 7, are delivered from the source along chutes 24 and 25, which terminate at cap drop position 27, which is located within the alignment portion 28 of capper apparatus 20. Alignment portion 28 also includes alignment unit 29. (See also FIGS. 11–13*b*).

Figure 4:
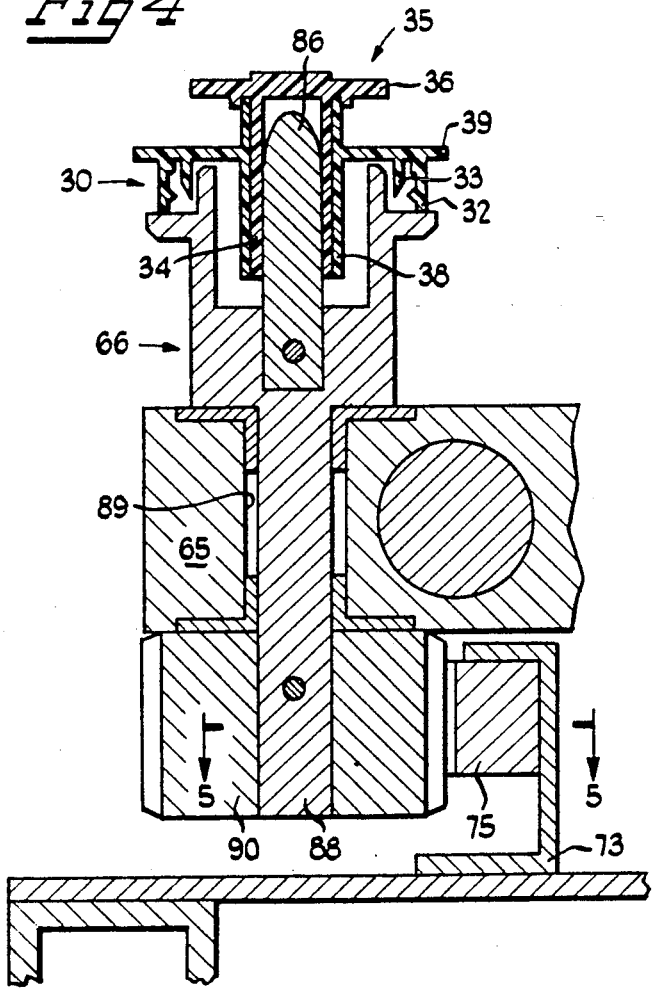
FIG. 4 is a front elevation in section of the cap seat and rotor mounted on the carriage block, in section, generally taken along line 3—3 of FIG. 2.
Figure 5:
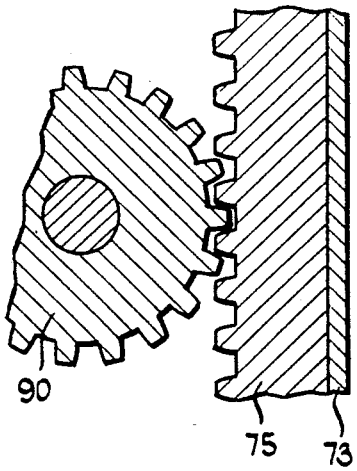
FIG. 5 is a top plan view, in section, of the rack and pinion taken generally along line 5—5 of FIG. 4.

Each cap, as seen in FIGS. 4, 6 and 7, has a seating portion 30, which is substantially radially symmetrical with respect to an axis X, and includes outer cylindrical wall 32 and inner cylindrical wall 33. Spout portion 35, which the consumer pulls out, along the direction of arrow A, in order to enable flow, may have a tab 36, which may be of any desired configuration. Stem 38 insertingly receives tube 34 of spout portion 35 for relative reciprocating movement into and out of stem 38. Tube 34 has an aperture (not shown) formed therein, generally transverse to the axis of the tube, for enabling flow of liquid from container 23, through tube 34. Cap 22 pictured has a flat, substantially pentagonally-shaped tab 36 to facilitate pulling. Tab 36 may, by indicia formed thereon or by its configuration, indicate the position of the aperture in tube 34. It is, of course, the location of the aperture which requires that each cap 22 be properly aligned on container 23. Both walls 32 and 33 descend from flange 39.

In these days of heightened awareness of consumer safety and the dangers of product tampering, many food or medically related products are being provided with tamper-indicating seals. Such a seal 40 is provided on cap 22. If spout portion 35 is pulled a predetermined distance or by a force of a certain value, then seal 40 breaks at some point along its length, to indicate possible tampering. Seal 40 can also act as an indicator useful for determining the rotational orientation of cap 22 relative to other components of apparatus 20 or to a container 23.

The operation of capper apparatus 20 will generally be described with reference to the left side of apparatus 20, as seen in FIG. 1, as it is to be understood that the structure and operation of the right side of apparatus 20 is substantially identical to that of the left side. Caps 22 enter chute 24, 25 in an inverted orientation. As chute 24, for example, loops over to reach cap drop position 27, caps 22 are flipped over to a right side up orientation. Chute 24 is formed with a substantially "C"-shaped configuration, with inner wall 43, side walls 44, 45 perpendicular to back wall 43, and outer walls 46, 47 which have a gap 48 between them. As each cap 22 leaves hopper 21, tab 36 enters the substantially rectangular space 49 enclosed by inner wall 43, side walls 44, 45, and outer walls 46, 47. Stem 38 extends through gap 48, with the remaining portions of the cap outside of chute 24. Once chute 24 has "looped" over, tab 36, being wider and deeper than gap 48, retain caps 22 in chute 24.

Depending on the relative widths of tab 36 and rectangular space 49, and that of stem 38 and seal 40, and gap 48, it may be possible to construct chute 24 so that caps 22 might be free to rotate within it. However, in practice, it is desirable to limit the amount of rotation possible, in order to protect the seal 40 from excessive stress and strain, and to facilitate the operation of alignment unit 29, as described hereinafter. Therefore, it may be desirable to dimension the widths of rectangular space 49 or of gap 48, so as to just accommodate the widths of tab 36 and stem 38, respectively. In particular, the width of gap 48 may be configured to be greater than the width of stem 38, but not that of stem 38 and seal 40 combined. Caps 22 would then be constrained to enter chute 24, with seals 40 either "leading" or "trailing" stem 38, in otherwise random order. The operation of alignment unit 29 is not affected by, nor does it depend on, the just-described optional configuration, though in practice it has been observed to reduce the likelihood of jamming or breakage of seals 40.

Figure 14:
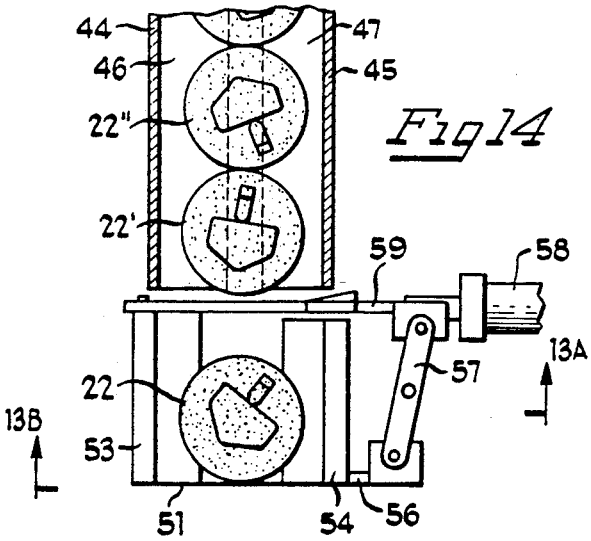
FIG. 14 is a top plan view, in section, of the trap and gate according to FIG. 13*a;*

Referring now particularly to FIGS. 1, 3, 13*a*, 13*b* and 14, as the caps arrive at cap drop position 27, they are retained, in succession, in trap 52, which is formed by jaws 53, 54. When a cap 22 is fed into trap 52, jaws 53 and 54 are closed. Gate 55 is positioned to one side of trap 52, to enable cap 22 to enter trap 52. Trap 52 has a wall 51 to keep cap 22 from moving forward beyond cap drop position 27. When jaws 53, 54 are opened, cap 22 falls down onto cap seat 60. It has been found that, in a situation, such as in the present invention, in which caps 22, 22', 22'', etc., descend down chute 24 under the force of gravity, the sheer number of caps can cause a substantial thrusting force, or back pressure, to be exerted upon the cap 22 which is actually within the trap. At times, the back pressure may be so great that cap 22 will be pinned within trap 52 and will not fall. Accordingly, gate 55 is provided to alleviate the back pressure created by the succeeding caps 22', 22''. As shown in FIG. 14, jaws 53 and 54 are interconnected by rods 58 and 56, to pivot arm 57. Rod 59 additionally is connected to piston and cylinder combination 58. Gate 55 is also driven by rod 59. Piston and cylinder combination 58 is suitably controlled so as to open jaws 53 and 54, when a cap seat 60 is available and positioned below trap 52. As jaws 53 and 54 open, gate 55 is driven by rod 59 to block access to trap 52. The leading edge of gate 55 is configured as a wedge, to drive the first cap 22' adjacent to the trap (as well as all succeeding caps) backward slightly, taking back pressure off of the cap 22 in trap 52, permitting it to drop freely. Once cap 22 has fallen, then jaws 53 and 54 are closed by reverse operation of piston and cylinder combination 58, and gate 55 is moved back to its original position, to the side of trap 52.

Alignment unit 29 includes carriage block 65, and cap seats 60 and 61, which are formed as the upper portions of rotors 66 and 67, respectively. Carriage block 65 is mounted for movement between cap drop position 27 and delivery position 70, along rails 71 and 72. Carriage block 65 may be propelled back and forth along rails 71 and 72, by any suitable means, such as a ball screw device, or a horizontally moving piston. Extending parallel to, and to the inside of, rails 71 and 72, are rack supports 73 and 74, respectively. Extending along the inside of each of rack supports 73 and 74 are racks 75, 76.

Figure 3:
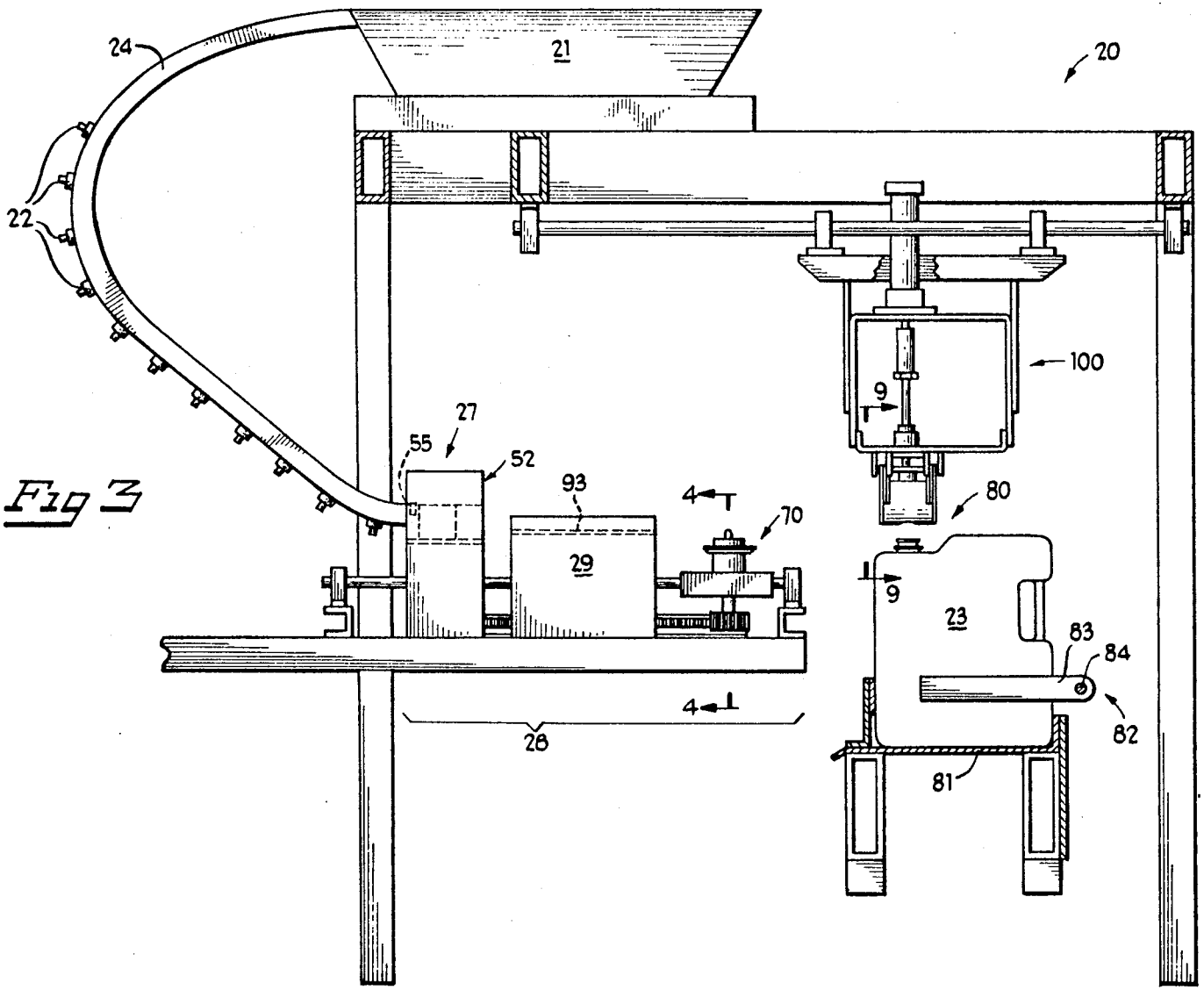
FIG. 3 is a left side elevation of the capper apparatus according to FIG. 1.

Referring to FIGS. 1 and 3, containers 23 are brought to capping position 80 along track 81. Any suitable means of propulsion may be used. For example, track 81 may itself comprise a conveyer belt. Alternatively, a shuttle system 82, comprising a plurality of spaced paddles 83, mounted on an axially reciprocating, rotatable shaft 84, may be employed, to move containers 23 along track 81 incrementally. In particular, when paddles 83 are in the horizontal position shown in FIG. 1, shaft 84 is shifted to the left, moving containers 23 into capping position 80. Once capping has been accomplished, shaft 84 rotates paddles 83 up to a vertical position (not shown), and shifts back to the right to bring the next two containers into the capping position 80.

Figure 11:
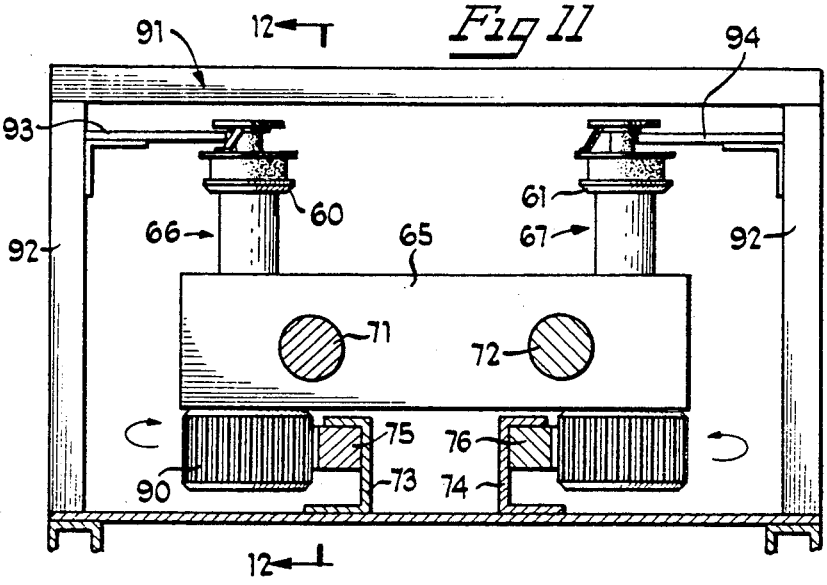
FIG. 11 is an elevation of the straight edges and support, rotors, and rack-and-pinions.
Figure 12:
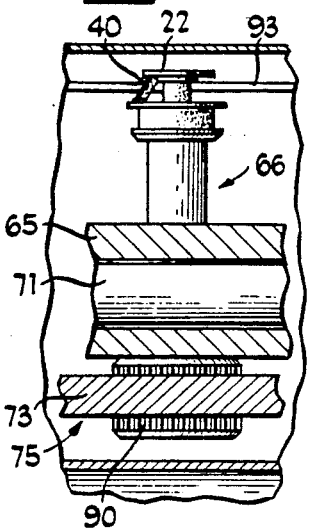
FIG. 12 is a side elevation, partially in section, of the straight edge and support according to FIG. 11.
Figure 13A:
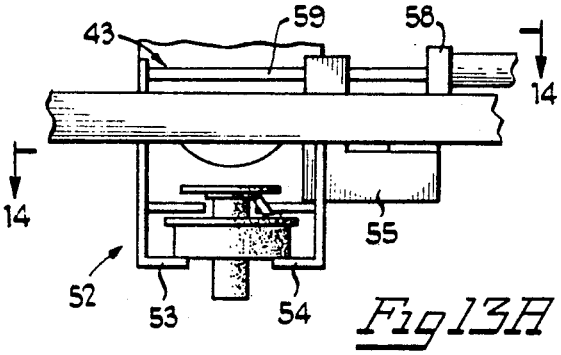
FIG. 13*a* is a front elevation showing the trap and gate assembly at the cap drop position, with the jaws of the trap closed.
Figure 13B:
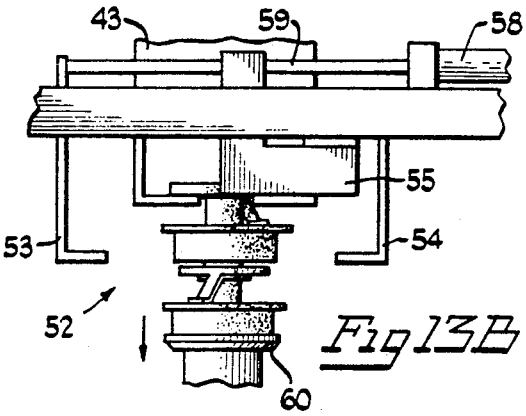
FIG. 13*b* is a front elevation of the trap and gate, with the jaws open and gate closed.

The operation of alignment unit 29 can be observed from FIGS. 11 and 12. It is to be understood that both sides of alignment unit 29 function in a substantially identical manner.

As previously mentioned, seating portion 30 of cap 22 is substantially radially symmetrical. Further, stem 38 has no radial projections. Cap seat 60, as seen in FIGS. 4, 11 and 12, is likewise formed substantially radially symmetrical. Indexing member 86, in the shape of a slender cone, facilitates the centering of cap 22 onto cap seat 60. As the components of cap seat 60 are fabricated from smooth metal, preferably stainless steel, and the components of cap 22 are smooth plastic material, such as nylon, there is very little potential friction force possible between cap 22 and cap seat 60.

FIG. 4 shows cap seat 60, which is integrally formed atop rotor 66. Projecting from the lower side of rotor 66 is rotor shaft 88, which extends through carriage block 65, in shaft bore 89. Rotor shaft 88 is coaxial with cap seat 60. Pinion 90 is mounted on the end of rotor shaft 88, coaxial thereto .

The seating of a cap proceeds as follows. As cap 22 arrives at cap drop position 27, carriage block 65 is waiting. Cap 22 lands on cap seat 60 in a substantially random angular orientation with respect to cap seat 60.

Immediately downstream from cap drop position 27 is cap alignment unit 29, as seen in FIG. 11 looking in the direction from cap drop position 27 toward delivery position 70. Frame 91 extends over and along rails 71, 72. Projecting from each side and just below the cross member of frame 91 are straight edges 93 and 94. Edges 93 and 94 are positioned so as to be at a height above flange 39 of cap 22, but below tab 36 of spout portion 35. In addition, edges 93 and 94 project away from side walls 92 and toward caps 22 such that there is only a slight clearance between, for example, edge 93 and stem 38 with no complete clearance for seal 40. Therefore, while rotor 66 is driven forward through frame 91, and caused to rotate by pinion 90 as indicated by the arrows, once rotor has begun to pass edge 93, seal 40 will abut edge 93. The rotation of cap seat 60, will cause seal 40 to tend to rotate "behind" cap 22, relative to the direction of transfer of cap seat 60. Cap 22 on cap seat 60 is shown abutting edge 93 while cap 22 on cap seat 61 is shown still in the process of rotation before abutting edge 94. Pinion 90 will continue to rotate, and cap seat 60 along with it, but cap 22 will be precluded from rotation, and in fact, will be translating forward in a fixed rotational orientation, against edge 93, until the end of edge 93 is passed.

At the end of the straight edge 93, the distance to delivery position 70 can be predetermined, so that a precalculated number of rotations brings rotor 66, cap seat 60 and cap 22 to delivery position 70 in the desired orientation for simple pick-up and placement on the container.

Once cap 22, on cap seat 60, has been brought to delivery position 70, in its proper desired alignment and orientation, cap 22 is then picked up and placed onto a fluid container 23 by cap mounting assembly 100. Frame work 101 supports capping carriage 102, which is supported on rails 103 and 104, for movement back and forth between delivery position 70 and capping position 80. Capping carriage 102 supports capper assemblies 106 and 107, which operate in a substantially identical manner.

Figure 10:
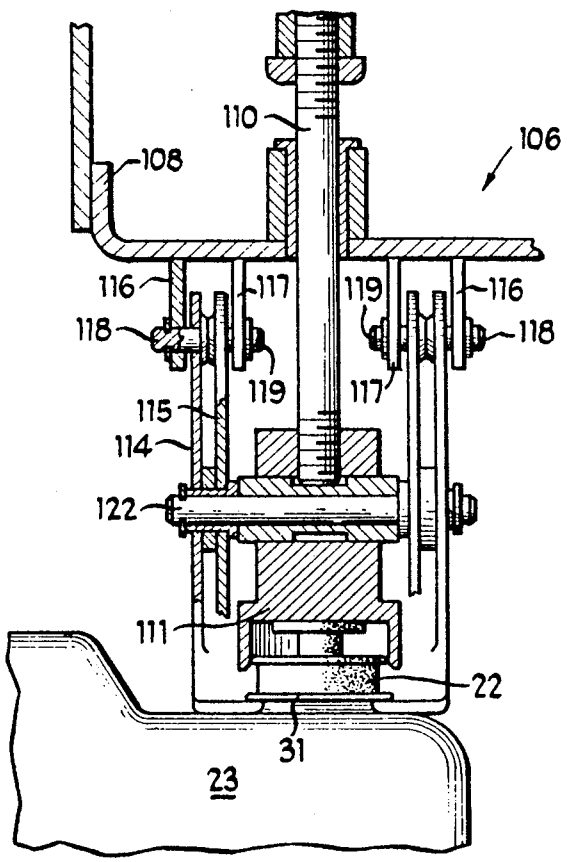
FIG. 10 is a side elevation, partly in section, of the cap holder and jaws for supporting the container, according to FIG. 10.
Figure 9:
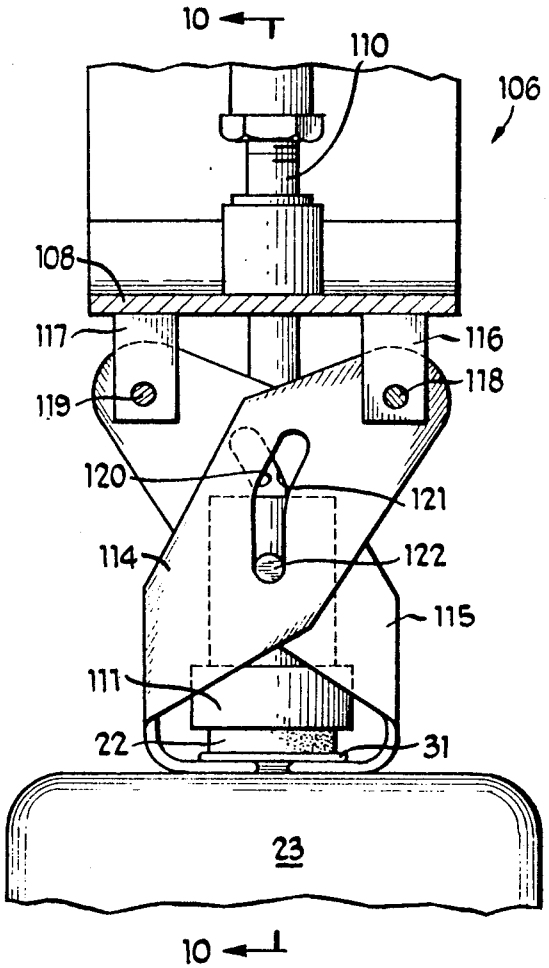
FIG. 9 is a front side elevation of the cap holder and jaws for supporting the container shown in the lower end of the stroke of the cap holder, with the jaws closed about the neck of the neck portion of the container.
Figure 8:
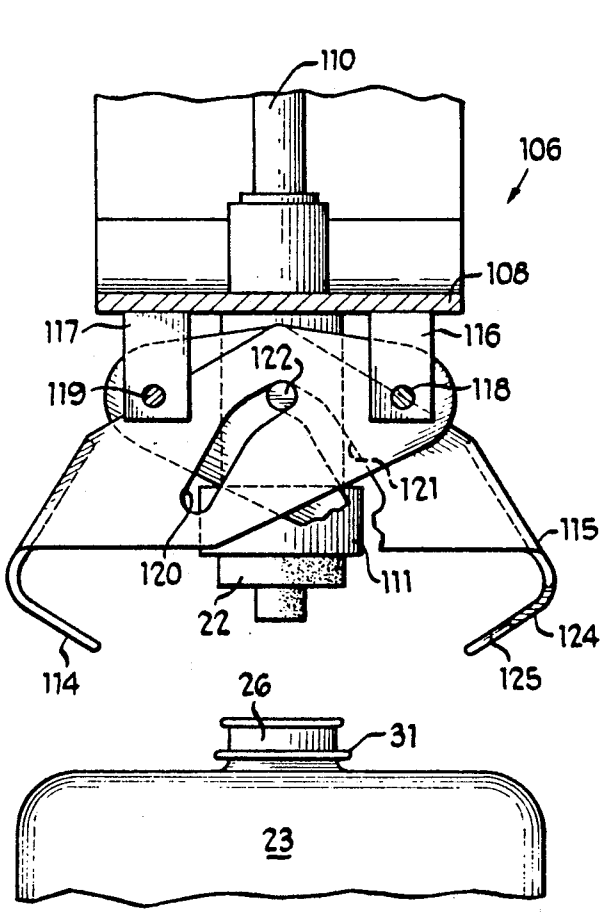
FIG. 8 is a front elevation of the cap holder and jaws for supporting the container, shown at the upper portion of the stroke of the cap holders.

Capper assembly 106 includes cylinder 109 which is configured to reciprocate shaft 110 within capper frame 108. Mounted at the bottom of shaft 110 is cap holder 111 which receives cap 22 in the desired aligned orientation and retains it by frictional engagement. Jaws 114 and 115 are suspended from capper frame 108 on supports 116, and 117, respectively, for rotation about pins 118 and 119, respectively. Jaws 114 and 115 have configured, in each side thereof, curved slots 120 and 121, respectively. Pin 122 extends transversely through cap holder 111 and projects laterally through both of slots 120 and 122, on both sides of jaws 114 and 115. Accordingly, as seen in FIGS. 8–10, when cylinder 109 activates driving piston 110 and cap holder 111 toward container 23, in order to place cap 22 onto neck 26 of container 23, as cap holder 111 moves downward, pin 123 moves downward with respect to each of slots 114 and 115. Since pin 122 cannot move with respect to cap holder 111, jaws 114 and 115 are constrained, through the movement of pin 122 along slots 120 and 121, simultaneously, to rotate towards each other.

As cap holder 111 approaches neck 26, jaws 114 and 115 first close around neck 26, under flange 31. As can be seen in the FIGS. 8 and 9, each of slots 120 and 121 are provided with a lower substantially straight portion, which ensures that jaws 114 and 115 reach their maximum rotation toward each other, before piston 110 reaches the bottom of its stroke. Each of jaws 114 and 115 includes an inwardly projecting rim 124 having an arcuate concave inner edge 125 that substantially conforms to the arcuate periphery of neck 26 under flange 31. By having jaws 114 and 115 close around neck 26 of container 23, under flange 31, as cap holder 111 presses downward upon neck 26, the force which is exerted by cap holder 111 onto container 23 is transmitted through neck 26 and flange 31 into jaws 114 and 115, so as to prevent crushing or other undesired loading on the remainder of container 23. Once cap 22 is pressed on neck 26 by piston 110, the frictional engagement between cap 22 and neck 26 is greater than the frictional engagement between cap 22 and cap holder 111 so that cap 22 is released from cap holder 111 upon retraction of piston 110. As piston 110 retracts, jaws 114 and 115 open to release the neck of the container.

The capping apparatus 20 of FIGS. 1–14 is shown using a straight line container shuttle, in which the containers are filled by a filling device (not shown) to one side of the capping apparatus. However, the same principles may also be applied to a rotary apparatus, as shown in FIGS. 15, 16 and 17.

Figure 15:
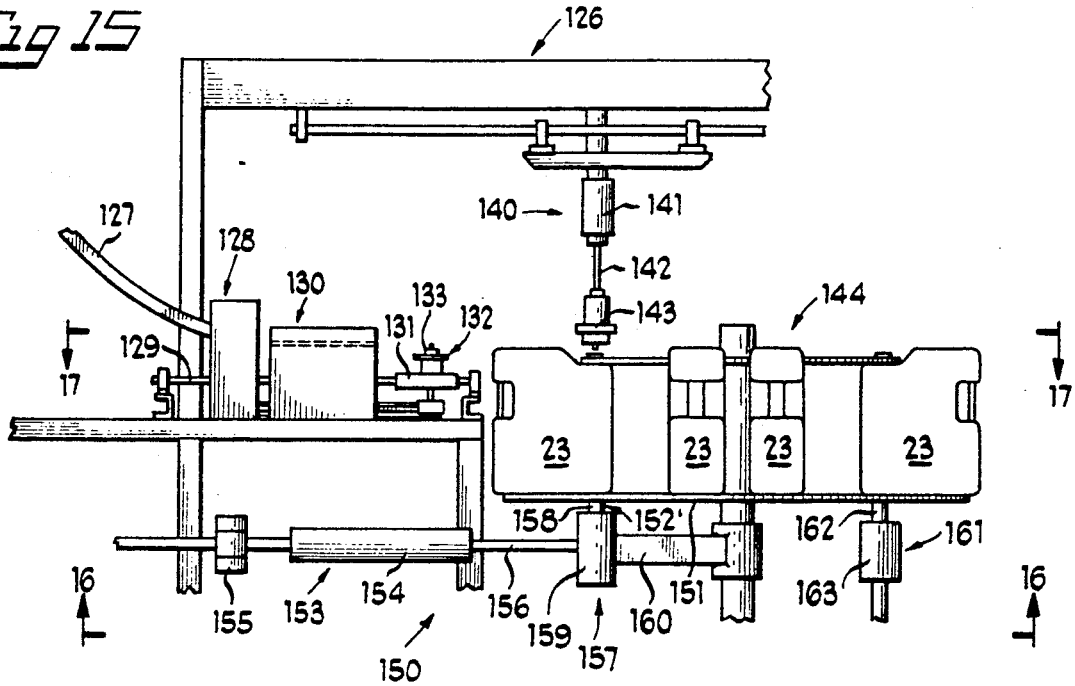
FIG. 15 is a side elevation of an alternative embodiment of the invention, showing the capper apparatus with a rotary container carrier.
Figure 17:
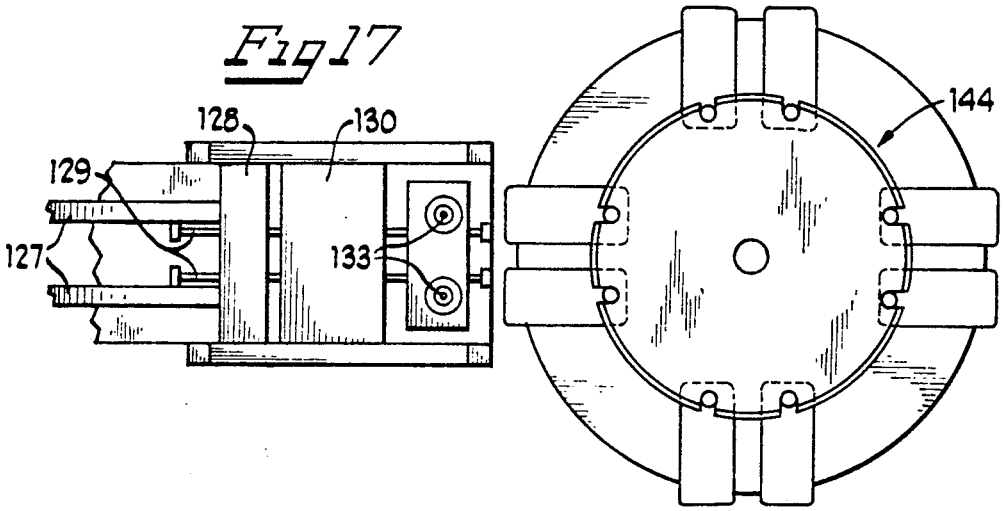
FIG. 17 is a top plan view of the apparatus according to FIG. 15.
Figure 16:
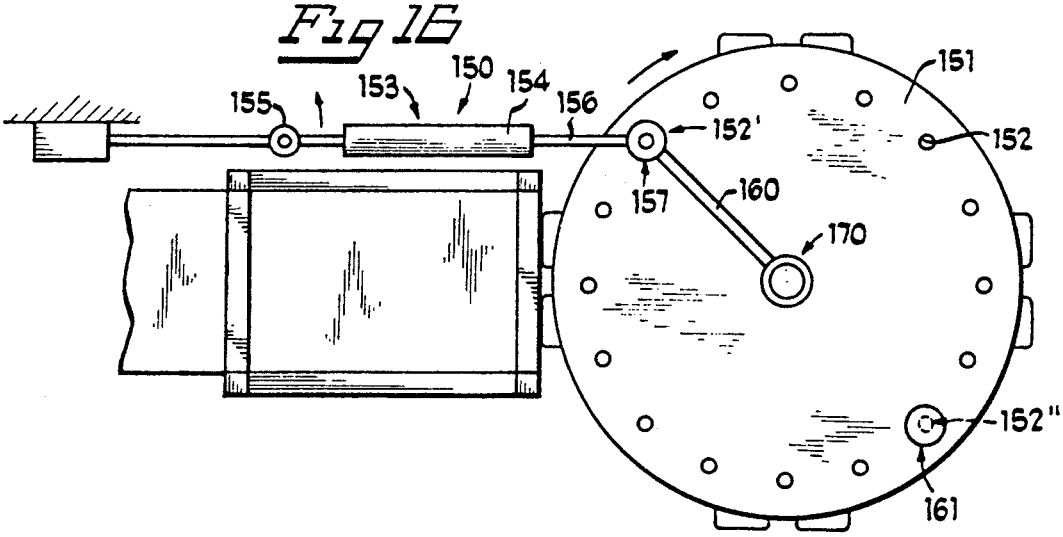
FIG. 16 is a bottom plan view of the apparatus according to FIG. 15, showing the indexing apparatus.

FIGS. 15–17 shows capper apparatus 126, which may be associated with a filling device. The nozzles and related attachments have been omitted from the drawings for ease of illustration. Capper apparatus 126 is configured for delivering and mounting two caps to paired containers, while three other pairs are either being filled and/or loaded on or unloaded from rotary carrier 144. Capper apparatus 126 includes chutes 127, cap drop position 128, rails 129, alignment unit 130, carriage block 131, rotors 132, and cap seats 133. Capper assembly 140 includes cylinders 141, pistons 142, and cap holders 143. As is typical with rotary container filling devices, containers 23 held in place on a rotary carrier 144, are already supported about the neck portion, and no jaws are necessary, though they may be provided if desired, as they are in the previously discussed embodiment. Aside from this distinction, the operation of capper apparatus 126 is substantially identical to that of capper apparatus 20.

Rotary apparatus 126 additionally includes indexing apparatus 150, as seen in FIGS. 15 and 16. It has been observed that if the alignment of a container 23 and a cap in cap holder 143, for example, are off by as little as 0.125 inches, the cap cannot be placed on the container. Therefore, the use of servomotors and the like to index carrier 144 through its 90 degree increments has been found to be unsatisfactory.

Accordingly, an alternative indexing system is used. Base 151 of carrier 144 is provided with apertures 152, 152', 152'', etc., radially uniformly positioned in a circular pattern. Horizontally acting cylinder and piston combination 153 is provided, with cylinder 154 pivotably mounted at 155. Piston 156 has vertically acting cylinder and piston 157 mounted at its end. Piston 158 is configured to engage an aperture 152', for example, when cylinder 159 is energized. Support arm 160, is pivotably mounted around axis 170 of carrier 144, as well as at its connection to cylinder 159. Locking cylinder and piston 161 are also configured to enable piston 162 to engage another aperture 152'', for example. In operation, when carrier 144 is stationary, such as during filling or capping operations, cylinder 163 is activated, and piston 162 engages an aperture 152, locking carrier 144 in place. When it is desired to rotate carrier 144, cylinder 163 is deactivated, cylinder 159 is activated and piston 158 engages aperture 152'. Horizontally acting cylinder 154 is activated, and its stroke is measured so as to propel carrier 144 through a one-quarter turn. Pivot 155 enables piston to swing during the stroke, as indicated by the curved arrow, to enable cylinder 159 to follow the arc described by apertures 152, 152', 152'', etc., during the indexing. Once the indexing is complete, cylinder 163 is reactivated, locking carrier 144 in its new position, cylinder 159 is deactivated to remove piston 158 from aperture 152', and horizontally acting cylinder 154 withdraws piston 156 to its original position. This procedure is repeated for each indexing of carrier 144, to bring two new bottles in position to be capped.

The foregoing description and drawings merely explain and illustrate the invention and the invention is not limited thereto except insofar as the appending claims are so limited, as those skilled in the art who have the disclosure before them will be able to make modifications in variations therein without departing from the scope of the invention.

What is claimed is:

1. An apparatus for mounting caps onto fluid containers in a particular predetermined orientation relative to said fluid containers, said caps each having a top portion, a bottom portion, with a substantially radially symmetrical seating portion and a substantially radially symmetrical central portion, intermediate said top and bottom portions, a radially outwardly extending element at a predetermined circumferential position on said central portion, said containers each having a neck portion and an opening arranged at an end of said neck portion, said apparatus for mounting caps onto fluid containers comprising;

a source of caps for said fluid containers;

means for transporting each of said caps in succession from said source to a cap drop position, said caps arriving at said cap drop position in random relative orientation between successive caps;

means for seating each of said caps after each of said caps has arrived at said cap drop position;

means for transferring said seating means from said cap drop position to a delivery position;

means for aligning said caps, one at a time, from said random relative orientation, into a predetermined seated alignment in said seating means, prior to arrival of said seating means at said delivery position, so as to orient said seating means and said caps, respectively, into a predetermined position for pick-up and securement of each of said caps onto said neck portion of a corresponding one of said fluid containers, said means for aligning said caps cooperating with said radially outwardly extending elements;

means for moving said fluid containers from a source of said fluid containers, successively, to a capping position; and means for picking up said caps at said delivery position and positioning said caps onto said neck portions of said corresponding fluid containers at said capping position to substantially cover the openings of said corresponding fluid containers.

2. The apparatus for mounting caps onto fluid containers according to claim 1, wherein said seating means further comprises:

a cap seat member, having a symmetrical upper seating surface configured thereon to correspond to said symmetrical seating portion of any one of said caps, each of said caps being deposited upon said cap seat member in succession by said means for transporting said caps when said seating means is in said cap drop position.

3. The apparatus for mounting caps onto fluid containers according to claim 2, wherein said aligning means comprises:

means for rotating said cap seat member; and means for permitting limited rotation of each of said caps cooperating with said radially outwardly extending element, until said caps each attain a predesigned orientation relative to said means for permitting limited rotation, and thereafter precluding rotation of each of said caps relative to said means for permitting limited rotation, until said seating means are transferred to a position a predetermined distance from said delivery position.

4. The apparatus for mounting caps onto fluid containers according to claim 3, wherein said cap seat member is configured to rotate with said caps, until said caps attain said predesigned orientation relative to said means for permitting limited rotation, said cap seat member thereafter being configured to continue to rotate, said rotation being relative to said cap, until said seating means passes said means for permitting limited rotation, said cap seat member and said cap thereafter resuming rotation together until said seating means arrives at said delivery position, said caps thereby being delivered to said delivery position in a predetermined orientation relative to said containers, such orientation being different from, but related to said predesigned orientation.

5. The apparatus for mounting caps onto fluid containers according to claim 4, wherein said means for permitting limited rotation of each of said caps comprises:

a guide member, operably positioned proximate the path of transfer of said seating means so that said radially outwardly extending element shall at said predesigned orientation abut said guide member as said cap rotates with said seating means, said cap thereafter being precluded from rotation relative to said means for permitting limited rotation as said seating means is transferred toward said delivery position, until said seating means passes said guide member.

6. The apparatus for mounting caps onto fluid containers according to claim 3, wherein said means for permitting limited rotation of each of said caps comprises:

a guide member, operably positioned proximate the path of transfer of said seating means so that said radially outwardly extending element shall at said predesigned orientation abut said guide member as said cap rotates with said seating means, said cap thereafter being precluded from rotation relative to said means for permitting limited rotation as said seating means is transferred toward said delivery position, until said seating means passes said guide member.

7. The apparatus for mounting caps onto fluid containers, according to claim 3, wherein said rotating means comprises:

a pinion operably arranged for rotation with said cap seat member; and a rack operably arranged for movement transversely to the axis of rotation of said pinion, to engage said pinion, and cause rotation of said cap seat member, as said cap seat member is transferred to said delivery position.

8. The apparatus for mounting caps onto fluid containers, according to claim 7, wherein said rotating means further comprises:

said pinion and said cap seat member mounted for rotation about a common axis of rotation.

9. An apparatus for orienting caps to be secured upon fluid containers in a predetermined orientation relative to said fluid containers, prior to placement and securement of said caps onto said fluid containers, said caps each having a top portion, a bottom portion, with a substantially radially symmetrical seating portion and a substantially radially symmetrical central portion, intermediate said top and bottom portions, a radially outwardly extending element at a predetermined circumferential position on said central portion, said fluid containers each having a neck portion and an opening arranged at an end of said neck portion, each of said caps being delivered to said apparatus for orienting caps from a source of said caps to a cap drop position, said caps arriving at said cap drop position in relative random orientation between successive caps, said apparatus for orienting caps comprising:

means for seating each of said caps after each of said caps has arrived at said cap drop position;

means for transferring each of said seating means from said cap drop position to a delivery position;

means for aligning each of said caps from said random relative orientation into a predetermined seated alignment in said seating means, prior to arrival of said seating means at said delivery position, so as to place said seating means and said caps, respectively, into a predetermined position for said placement and securement onto said fluid containers, said means for aligning said caps cooperating with said radially outwardly extending element.

10. The apparatus for orienting caps according to claim 9, wherein each of said seating means further comprises:

a cap seat member, having a symmetrical upper seating surface configured thereon to correspond to said symmetrical seating portions of said caps, said caps being deposited upon said cap seat member when said seating means is in said cap drop position.

11. The apparatus for mounting caps onto fluid containers according to claim 10, wherein said aligning means comprises:

means for rotating said cap seat member; and means for permitting limited rotation of each of said caps cooperating with said radially outwardly extending element, until said caps each attain a predesigned orientation relative to said means for permitting limited rotation, and thereafter precluding rotation of each of said caps relative to said means for permitting limited rotation, until said seating means are transferred to a position a predetermined distance from said delivery position.

12. The apparatus for mounting caps onto fluid containers according to claim 11, wherein said cap seat member is configured to rotate with said caps, until said caps attain said predesigned orientation relative to said means for permitting limited rotation, said cap seat member thereafter being configured to continue to rotate, said rotation being relative to said cap, until said seating means passes said means for permitting limited rotation, said cap seat member and said cap thereafter resuming rotation together until said seating means arrives at said delivery position, said caps thereby being delivered to said delivery position in a predetermined orientation relative to said containers, such orientation being different from, but related to said predesigned orientation.

13. The apparatus for mounting caps onto fluid containers according to claim 12, wherein said means for permitting limited rotation of each of said caps comprises:

a guide member, operably positioned proximate the path of transfer of said seating means so that said radially outwardly extending element shall at said predesigned orientation abut said guide member as said cap rotates with said seating means, said cap thereafter being precluded from rotation relative to said means for permitting limited rotation as said seating means is transferred toward said delivery position, until said seating means passes said guide member.

14. The apparatus for mounting caps onto fluid containers according to claim 11, wherein said means for permitting limited rotation of each of said caps comprises:

a guide member, operably positioned proximate the path of transfer of said seating means so that said radially outwardly extending element shall at said predesigned orientation abut said guide member as said cap rotates with said seating means, said cap thereafter being precluded from rotation relative to said means for permitting limited rotation as said seating means is transferred toward said delivery position, until said seating means passes said guide member.

15. The apparatus for orienting caps according to claim 11, wherein said means for rotating said cap seat member comprises:

a pinion operably arranged for rotation with said cap seat member; and a rack operably arranged for movement transversely to the axis of rotation of said pinion, to engage said pinion, and cause rotation of said cap seat member, as said cap seat member is transferred to said delivery position.

16. The apparatus for orienting caps according to claim 15, wherein said means for rotating said cap sat member comprises:

said pinion and said cap seat member mounted for rotation about a common axis of rotation.

* * * * *

UNITED STATES PATENT AND TRADEMARK OFFICE

CERTIFICATE OF CORRECTION

PATENT NO. : 5,150,559

DATED : September 29, 1992

INVENTOR(S) : Edward O. Winfield

It is certified that error appears in the above-identified patent and that said Letters Patent is hereby corrected as shown below:

| | |
|---|---|
| Column 4, Line 40 | After device and before Capper insert --.-- |
| Column 12, Line 58 | Delete "sat" and instead insert --seat-- |

Signed and Sealed this

Twenty-sixth Day of October, 1993

*Attest:*

*Attesting Officer*

Bruce Lehman

BRUCE LEHMAN

*Commissioner of Patents and Trademarks*